US006523183B1

(12) United States Patent
Wright et al.

(10) Patent No.: US 6,523,183 B1
(45) Date of Patent: Feb. 25, 2003

(54) TROUSERS FOR BOW HUNTERS

(76) Inventors: Kenneth K. Wright, 600 Lincoln St., Bay City, MI (US) 48708; Tammy L. Wright, 600 Lincoln St., Bay City, MI (US) 48708

( * ) Notice: Subject to any disclaimer, the term of this patent is extended or adjusted under 35 U.S.C. 154(b) by 0 days.

(21) Appl. No.: 10/004,962

(22) Filed: Dec. 3, 2001

(51) Int. Cl.[7] ..... A41D 13/00; A45F 5/00
(52) U.S. Cl. ..... 2/227; 2/69; 224/222
(58) Field of Search ..... 2/227, 79, 69, 2/69.5, 94, 242, 271, 231, 232, 247, 250; 224/222, 219, 267, 269, 270, 916, 191; 24/3.1, 3.2

(56) References Cited

U.S. PATENT DOCUMENTS

| | | | | |
|---|---|---|---|---|
| 2,520,285 A | | 9/1950 | Olson | |
| 2,635,246 A | | 4/1953 | Olson | |
| 3,208,653 A | | 9/1965 | Wallace | |
| 3,232,501 A | | 2/1966 | Merenda | |
| 4,384,369 A | * | 5/1983 | Prince | 2/79 |
| 4,895,285 A | | 1/1990 | Dunn | |
| 5,669,078 A | * | 9/1997 | Scremin et al. | 2/247 |
| 5,826,273 A | * | 10/1998 | Eckes | 2/69 |
| 5,850,955 A | | 12/1998 | Barr | |
| 6,375,052 B2 | * | 4/2002 | Keton | 224/222 |

* cited by examiner

*Primary Examiner*—Gloria M. Hale
(74) *Attorney, Agent, or Firm*—Reising, Ethington, Barnes, Kisselle, Learman & McCulloch, P.C.

(57) ABSTRACT

The trousers for bow hunters have a bow rest pocket on the outside of one or both legs of the trousers and below the knee. The bow rest pocket is formed by a generally triangular panel that is sewn to the trousers leg along a generally horizontal panel edge and along a generally vertical panel edge. The bow rest pocket is open upwardly and rearwardly. The bow rest pocket is positioned on a trouser leg in a position that minimizes the movement required to draw, aim and shoot at a wild animal from a ground blind or a tree stand. The bow rest pocket can support a bow or a camera mounted on a monopod or support leg.

11 Claims, 3 Drawing Sheets

TROUSERS FOR BOW HUNTERS

TECHNICAL FIELD

This invention relates to trousers for bow hunters and more particularly to trousers with a weapon rest pocket on one or both trouser legs beneath the knee for supporting a bow while sitting in a blind or on a tree stand.

BACKGROUND OF THE INVENTION

The most productive type of hunting for the whitetail deer with a bow and arrow is from a tree stand or a blind. While sitting in a blind or on a tree stand a bow hunter must keep movement and noise to a minimum. The goal of all bow hunters is to put themselves into a position to take a close-range shot at an undisturbed animal. To that end a hunter must spot the animal before it sees, hears or smells him. Once a deer is spotted, a hunter must wait for the deer to get close enough for the shot and be able to draw a bow and release an arrow undetected by the deer (The Field & Stream Bowhunting Handbook). Most wild animals have good vision that allows them to detect movement from a substantial distance.

Bow hunters generally use compound bows. The biggest advantage of using a compound bow is that it allows the hunter to hold the bow and arrow at full draw to aim and wait for the best opportunity to take a shot. Many hunters draw their bows as soon as the deer are within range and then attempt to hold their shots until the deer offer the perfect shot. The deer's movement may mean that a hunter has to hold the bow longer than anticipated. Holding a drawn bow for even a short period of time will cut a hunter's accuracy tremendously.

Bow hunters frequently sit in their blinds or on tree stands for periods exceeding an hour waiting for an animal to move, not only into view, but within shooting range. The literature is full of photographs showing bow hunters sitting on tree stands with their bows laying across their laps. Bow holders are commercially available which consist of hooks that screw into the tree trunk or clamp onto the stand's platform to keep a bow within an arm's reach while waiting for the animal to approach. Such devices are listed as accessories for successful and safe hunting from a tree stand. Placing a bow in a holder requires retrieval that takes time and requires movement. So does lifting a bow from one's lap and rotating it from laying horizontally into a vertical position from which it may be drawn and shot. As stated above, such movement, if detected by the animal, will likely destroy the hunter's opportunity to draw and shoot.

Most bow hunters are going to take a shot at 30 yards or less. When an animal moves into view, the hunter must be ready to move his bow into a position to shoot prior to the animal moving out of view and prior to being detected. For a bow this should mean simply bringing it to a full draw. Once the weapon is in a shooting position it must be drawn and held steady while sighting and shooting. As previously stated, the longer it is held at a full draw generally the less accurate the shot.

SUMMARY OF THE INVENTION

Trousers for bow hunters include a lower torso covering trousers portion. A left tubular trouser leg depends from the lower torso covering portion and has an inwardly facing surface, an outwardly facing surface, a knee area and a bottom edge. A right tubular trouser leg depends from the lower torso covering portion and has an inwardly facing surface, an outwardly facing surface, and a bottom edge. For a right-handed hunter, a weapon rest pocket is attached to the outwardly facing surface of the left leg between the knee and the bottom edge and has an open pocket edge that is open upwardly and rearwardly. The weapon rest pocket is on the opposite leg for a left-handed bow hunter, so that a weapon rest pocket is attached to the outwardly facing surface of the right leg between the knee and the bottom edge and has an open pocket edge that is open upwardly and rearwardly for a left-handed bow hunter. A pair of trousers for bow hunters could be equipped with a pocket on either leg or both legs depending on cost and preferences of hunters.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
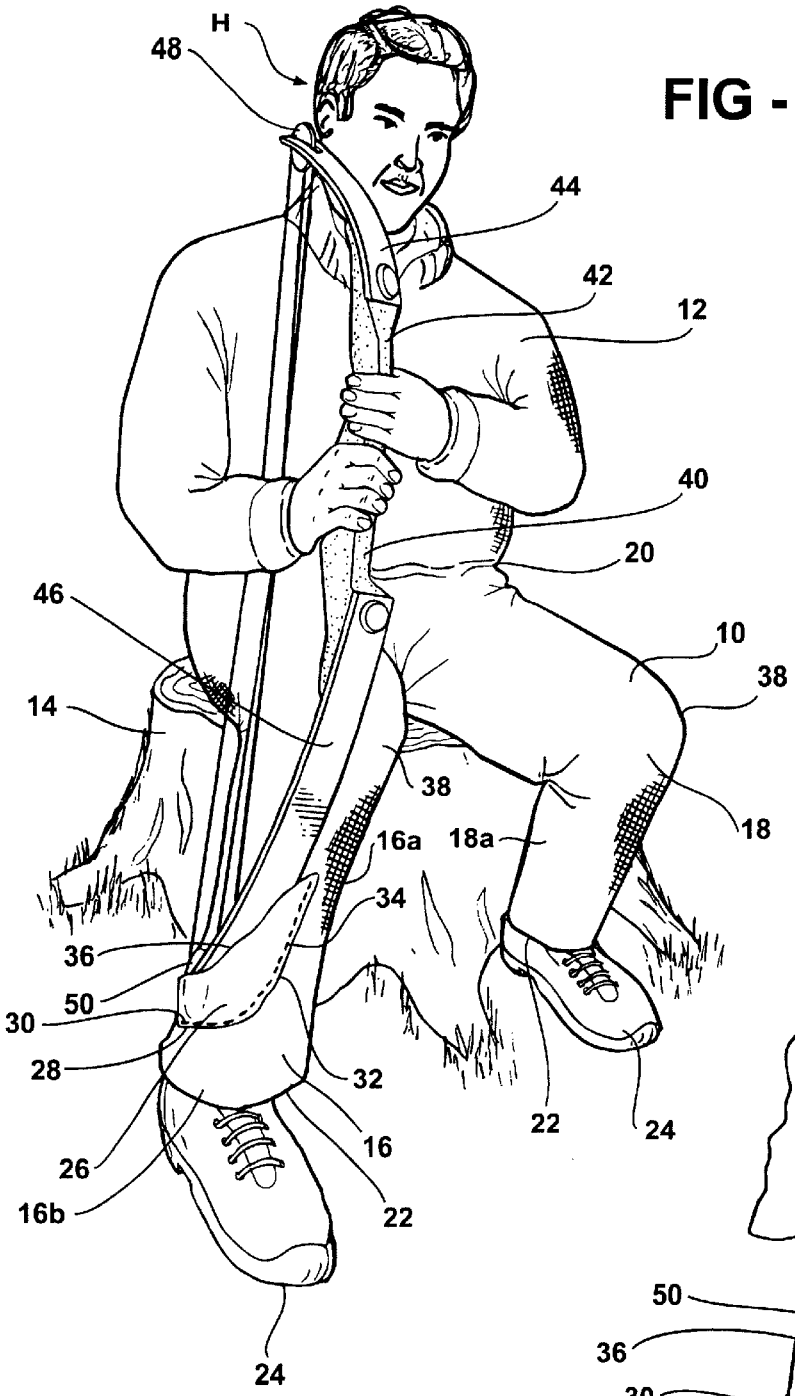
FIG. 1 is a perspective view of a left-handed hunter holding a compound bow with the lower end of the bow in the bow rest pocket on the right leg of the trousers.
Figure 2:
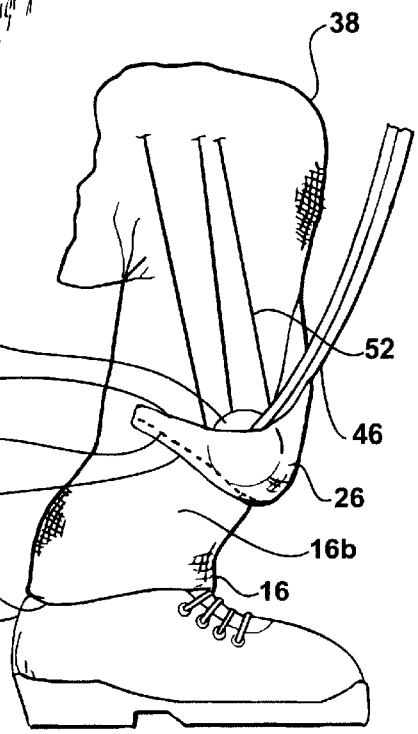
FIG. 2 is an enlarged side elevational view of a right trouser leg with the bow rest pocket, a bow resting in the weapon rest pocket, and with parts broken away.

The hunter H, as shown in FIG. 1, is wearing trousers 10, a shirt 12 and sitting on a tree stump 14. The shirt 12 and trousers 10 are generally camouflaged to correspond with the surrounding. A wide array of camouflage patterns are commercially available with designs intended to break up the hunter's outline in every condition from a snowy northern woods, to a mossy stand of oak in a southern swamp or to simply match the bark of the tree his stand is in. The shirt 12 could be a jacket, or a parka. The shirt 12 and trousers 10 can be two separate items as shown, bib overalls with a shirt or jacket underneath, or a one-piece suit.

A tree stump 14, may be available to serve as a seat on the ground, as could a large bucket, or any of a number of styles of commercially available chairs designed for use when hunting. A hunter H when sitting on the ground would most likely employ a blind of some sort for concealment. Generally, ground blinds may consist of dead natural materials in the area such as deadfall to which brush is gathered and added where needed, a permanently constructed blind, a handmade hut of some sort or a portable blind. Portable blinds are generally a commercially made enclosure employing a frame like a tent and a camouflage fabric cover. A blind is not shown in the drawing.

The trousers have a right trouser leg 16, a left trouser leg 18 and a waist band 20. The bottom edge 22 of each trouser leg 16 and 18 slides over the top of a boot 24. A cuff is generally eliminated from the bottom of each trouser leg 16 and 18. Cuffs can catch on vegetation and impede movement of a hunter H. The right trouser leg 16 is tubular, and has an inwardly facing surface, 16*a* and an outwardly facing surface 16*b*. The left trouser leg 18 is also tubular, has an inwardly facing surface, 18*a* and an outwardly facing surface 18*b*.

Figure 3:
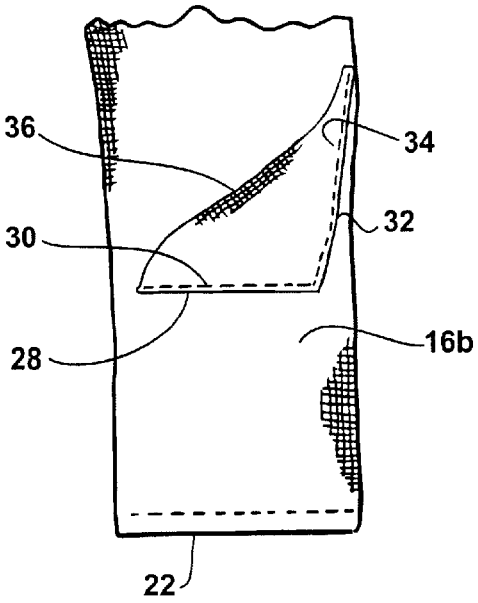
FIG. 3 is a side elevational view of a right trouser leg with an empty bow rest pocket and with parts broken away.

The hunter H in FIG. 1 being left-handed, is holding the bow in his right hand to the outside of his right knee as he sits. A bow rest pocket 26 is sewn to the outwardly facing surface 16*b* of the right leg below the knee and above the bottom edge 22. The pocket 26 is sewn along a rest pocket bottom edge 28 by a seam of stitches 30 and along a rest pocket front edge 32 by a seam of stitches 34. The seam of stitches 30 is generally horizontal and parallel to the bottom edge as shown in FIG. 3. The rest pocket front edge and the seam of stitches 34 are generally vertical. The open edge 36 of the pocket is open upwardly and to the rear and extends from the rear of the bottom edge 28 to the top of the front edge 32. The actual location of the rest pocket 26 in relation to the bottom of each trouser leg depends upon the stature of the hunter, length of the bow, stretch of the pocket fabric and the preference of the hunter. An approximate location of the bottom edge 28 of the pocket would be one-half of the distance between the hunter's ankle and knee.

The hunter H shown in FIG. 1 is hunting with a compound bow 40. The bow 40 includes a rigid upright riser 42 with a handgrip. An upper limb 44 and a lower limb 46 are secured to the riser 42. An upper cam and pulley assembly 48 is mounted on the upper limb 44. A lower cam and pulley assembly 50 is mounted on the lower limb 46. A cable 51 is trained around the pulley assemblies 48 and 50.

Figure 4:
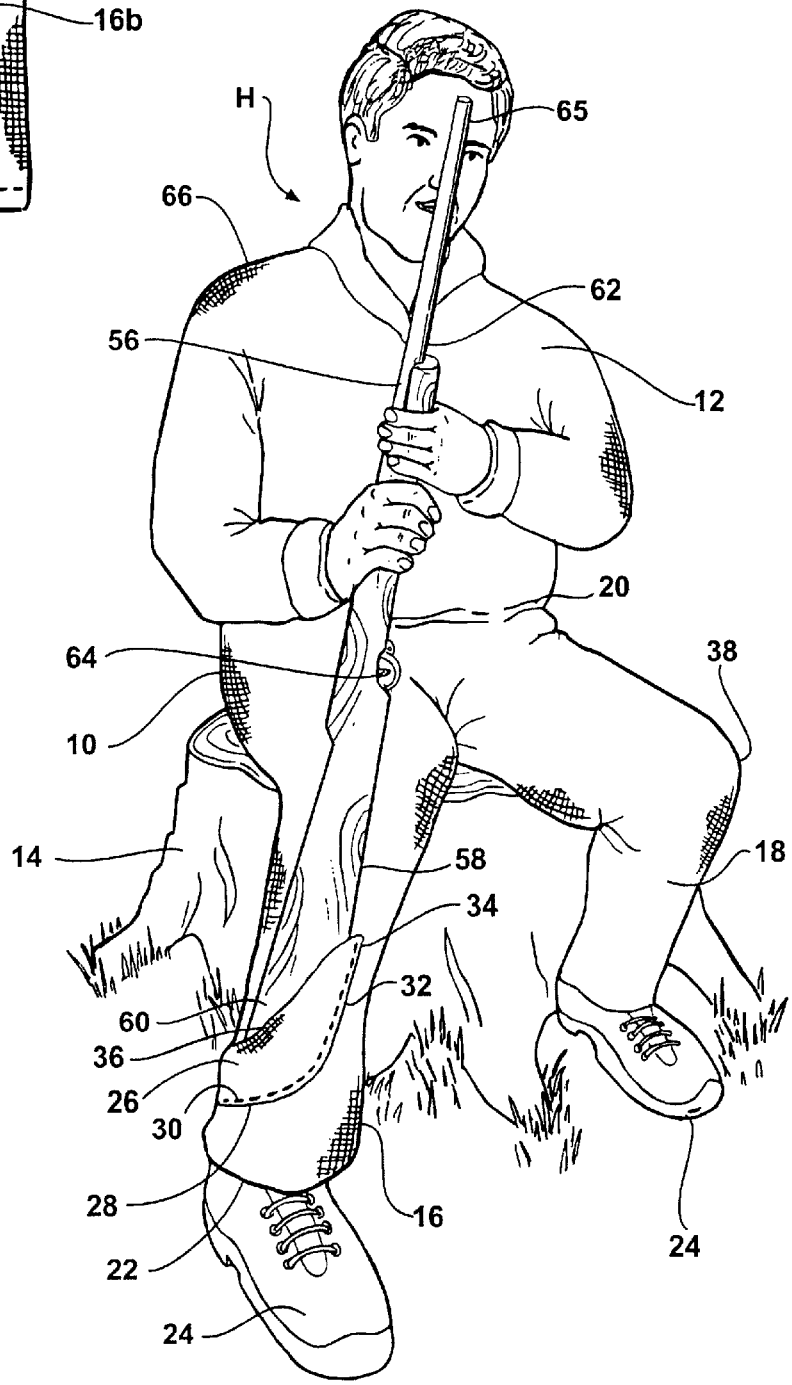
FIG. 4 is a perspective view similar to FIG. 1 with a camera on a camera support pole resting in the weapon rest pocket.

A bowstring 52 is attached to the ends of the cable 51. The end of the lower limb 46 with cam and pulley assembly 50 is sitting in the bow rest pocket 26. The pocket 26 is bearing the weight of the bow 40. The hunter's right arm is holding the bow 40 upright but not bearing its weight. Again, because the hunter H shown in FIG. 1 is left-handed, the bow rest pocket 26 is on the outwardly facing surface 16*b* of the right trouser leg 16. For a right-handed hunter H, the bow rest pocket 26 belongs on the outside surface 18*b* of the left trouser leg 18, as shown in FIG. 4.

An arrow 54 is preferably nocked to the bowstring 52 and sits on an arrow rest attached to the riser 42 while hunter H waits in a blind or on a tree stand for an animal to appear. An arrow rest is not shown in the drawing for simplicity. When an animal is in range, the hunter H merely tightens his grip on the riser 42 with the nondominant hand, draws the bowstring 52 back, aims and releases the arrow 54. The bow rest pocket 26 being on the outside of the leg on the hunter's nondominant side, the hunter is in a very classic seated position from which to draw, aim and shoot. Seated near ground level, as in FIG. 1, the hunter H may desire to raise the lower limb 46 and cam assembly 50 of the bow 40 from the pocket 26 as he draws and aims. A hunter H in a tree stand 70 as shown in FIG. 5, may leave the lower limb 46 and cam assembly 50 of the bow 40 in the bow pocket 26 while drawing and shooting.

It is ideal to leave the lower limb 46 of the bow 40 in the bow rest pocket 26 at all times, with an arrow 54 nocked to the bow string 52 and the hunter's shooting hand on a release aid or on the bow string at the ready. From such position, the hunter H needs only to draw, aim and shoot when an animal approaches. Movement of the bow 40 and the hunter H are thereby minimized. The bow 40 need not be retrieved from a holder or rotated, from resting horizontally on the lap, into the vertical shooting position. Again, preparedness and minimizing movement are of paramount importance to bowhunting success.

Figure 5:
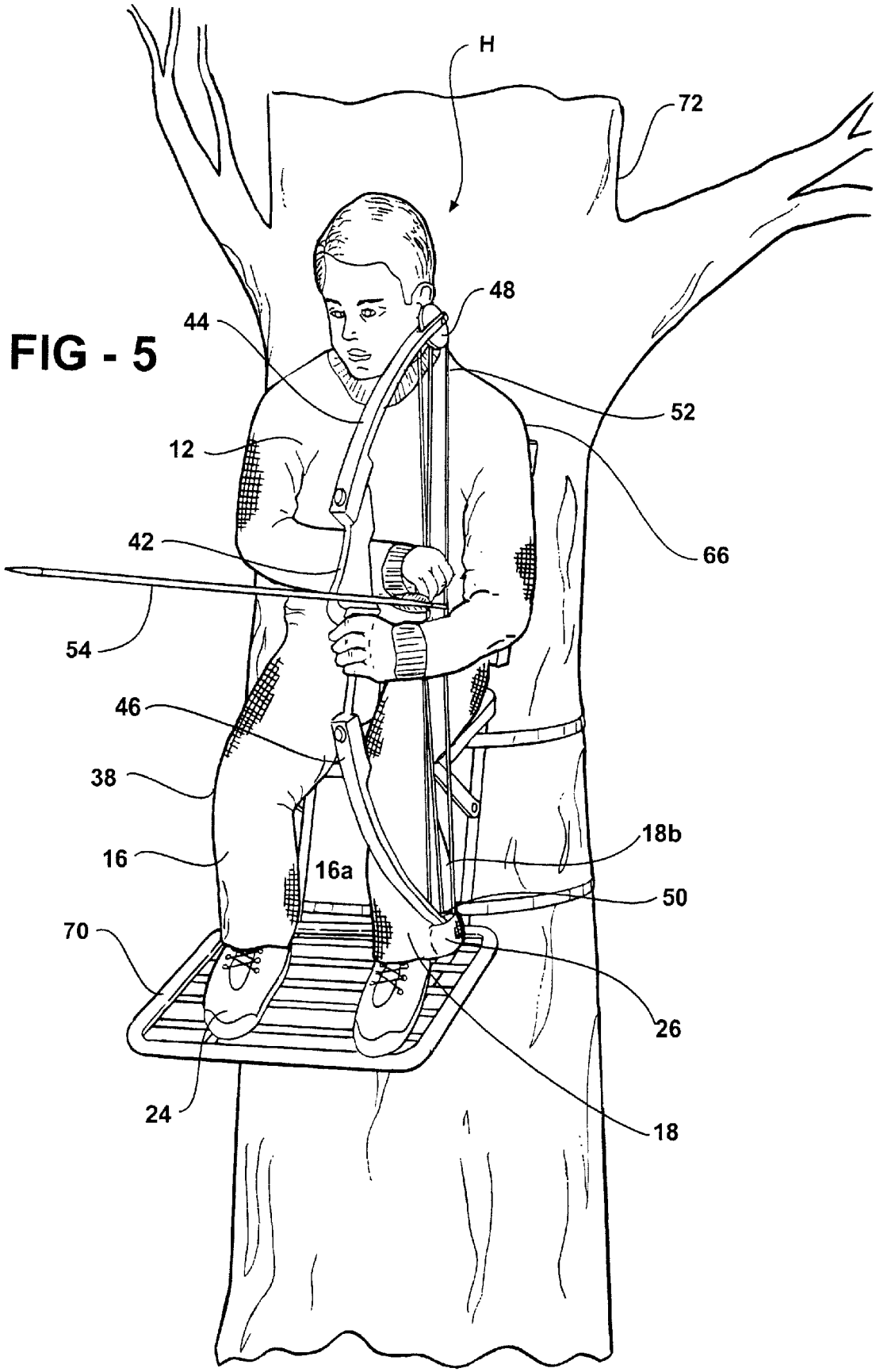
FIG. 5 is a perspective view of a right-handed hunter on a tree stand holding a compound bow with his left hand, with the lower end of the bow in the weapon rest pocket, right arm across his abdomen, right hand on the drawstring or on the release aid which is attached to the draw string, ready to draw, aim and shoot.

As previously stated, the hunter H shown in FIG. 5, is sitting on a tree stand 70 attached to a tree 72. A blind could be employed to conceal the hunter H while on the tree stand 70. When sitting on a tree stand 70 it is generally necessary to shoot downward. If desired, the hunter's bow may be rotated downward, pivoting on the lower limb 46 and cam assembly 50 while the bow remains in the bow rest pocket 26, before the hunter draws, aims and shoots. Such would allow the bow to be sighted on a target that is closer to, and thus more directly beneath, the tree 72.

Bows 40 can weigh several pounds. Holding a bow with one or both hands for an extended period of time can tire hand, arm, shoulder, neck, and back muscles. When the muscles are tired, it is difficult to hold a bow 40 steady, obtain a proper sight picture, and as stated above, obtain an accurate shot. Holding a bow 40 in the bow rest pocket 26 removes the weight of the bow from the hands, arms, shoulders or back of a hunter H. When using the rest pocket 26, it remains necessary to steady the bow 40 in an upright position, but little or no strength is required to do so. While the bow 40 is in the pocket 26 the riser 42 or lower limb 46 of the bow 40 can also be rested against the hunter's leg, further reducing the possibility of arm fatigue. The hunter H may sit comfortably with the bow in the rest pocket 26, an arrow nocked on the bow string 52 and his shooting hand on either the release device or bow string 52 with his shooting arm comfortably across his abdomen, as shown in FIG. 5.

The bow rest pockets 26 are, as explained above, on an outwardly facing surface 16*b* or 18*b* of a trouser leg 16 or 18. The outwardly facing surfaces 16*b* and 18*b* face away from the hunter at somewhat less than right angles. Ideally each rest pocket 26 is positioned so as to minimize the movement of the hunter needed to bring the bow 40 into a position which permits the hunter to draw, aim and shoot.

Some hunters H hunt with a camera 80, as shown in FIG. 4 and take photographs or make videotapes of animals. The bow rest pocket 26 can also be used to support the camera 80 on a monopod or support leg 82 while the photographer sits in a ground blind or on a tree stand 70. The support leg 82 would be held up off the ground and could be moved rapidly and silently by the photographer moving the leg on which the camera 80 is supported by the rest pocket 26.

The trouser legs 16 and 18 are made from a material that can support the weight of a bow 40 or a camera 80 with a support leg 82. If necessary reinforcing straps or backing material could be added to the trousers and pocket 26 at the seams for additional strength. If desired, a releasable flap could close over the bow rest pocket 26 while the hunter H is traversing to or from his ground or tree blind, to prevent pieces of vegetation from collecting in the pocket where they could cause noise or otherwise interfere with drawing, aiming or shooting.

The rest pocket 26 as described above is a patch pocket with the patch on the exterior of the outside surface 16*b* or 18*b* of a trouser leg 16 or 18 as described above. The rest pocket 26 can be formed using other known pocket constructions. The patch member forming the rest pocket 26 could, for example, be on an interior surface of a trouser leg 16 or 18 rather than on an exterior surface. With an interior patch, the rest pocket 26 would look the same as it appears in FIG. 3 except that the bottom edge 28 and front edge 32 would be hidden lines indicating that the patch is on the interior. The open edge 36 would indicate an opening in the trouser leg 16 or 18. Another possible construction for a rest pocket 26 is a complete pocket sewn to the edges of the open edge 36 formed by a slit in the fabric forming the trouser leg 16 or 18. The stitches 30 and 34 would not show on the outside as they do in FIG. 3 with a complete pocket sewn to the edges of an opening and forming the open edge 36.

The open edge 36 of the rest pocket 26, with any type of pocket construction, extends upward and forward from the rear of the pocket bottom edge 28 to the top of the front edge 32. This makes it possible to remove a bow 40 or other object from the rest pocket 26 by moving the lower end of the bow upward or rearward a short distance. If an animal is in a position which requires removal of the bow 40 or other object from the rest pocket 26, moving the portion received in the rest pocket upward, rearward or a combination of the two directions will generally move a bow 40 or camera 80 toward a position for sighting on an animal and minimize total movement. By minimizing movement, the chance of being detected is reduced as explained above. By extending the open edge 36 upward and forward the bottom edge 28 to the front edge 32 of the rest pocket 26, the chance of a bow or other device becoming stuck or held inside the pocket, when removal is required by the hunter H to sight on an animal is minimized.

The disclosed embodiment is representative of a presently preferred form of the invention, but is intended to be illustrative rather than definitive thereof. The invention is defined in the claims.

We claim:

1. Trousers for hunters comprising:

a lower torso covering trouser portion;

a first tubular trouser leg depending from said lower torso covering trouser portion and having a first inwardly facing surface, a first outwardly facing surface, and a first bottom edge;

a second tubular trouser leg depending from said lower torso covering trouser portion and having a second inwardly facing surface, a second outwardly facing surface and a second bottom edge; and a rest pocket attached to at least the first tubular trouser leg between a first knee and the first bottom edge and having a first open pocket edge on the first outwardly facing surface of the first tubular trouser leg that is open upwardly and rearwardly for ingress and egress.

2. Trousers for hunters, as set forth in claim 1, wherein the first open pocket edge of the rest pocket extends upwardly and forwardly to a first rest pocket front edge.

3. Trousers for hunters, as set forth in claim 1 wherein the first open pocket edge of the rest pocket extends downwardly and rearwardly to a first rest pocket bottom edge.

4. Trousers for bow hunters, as set forth in claim 1, wherein the first open pocket edge of the rest pocket extends upwardly and forwardly from a first rest pocket bottom edge to a first rest pocket front edge.

5. Trousers for hunters, as set forth in claim 1, wherein the rest pocket is formed by a generally triangular shaped panel with a generally vertical first front pocket edge attached to the first tubular trouser leg by a first generally vertical seam of stitches, a generally horizontal first bottom pocket edge attached to the first tubular leg by a first generally horizontal first seam of stitches, and wherein the first open pocket edge extends upwardly and forwardly to a first generally vertical front pocket edge.

6. Trousers for hunters, as set forth in claim 1 wherein the first and second tubular trouser legs and the rest pocket are made from a fabric material.

7. Trousers for hunters comprising:

a lower torso covering trouser portion;

a first tubular trouser leg depending from said lower torso covering trouser portion and having a first inwardly facing surface and a first outwardly facing surface, a first knee and a first bottom edge;

a second tubular trouser leg depending from said lower torso covering trouser portion and having a second inwardly facing surface and a second outwardly facing surface, a second knee, and a second bottom edge;

a rest pocket including a generally triangular shaped panel attached to the first tubular trouser leg between the first knee and the first bottom edge by a row of generally vertical stitches and a row of generally horizontal stitches, and wherein the rest pocket has a rest pocket opening extending from the row of generally horizontal stitches upwardly and forwardly to the row of generally vertical stitches.

8. Trousers for hunters, as set forth in claim 7, wherein the row of generally horizontal stitches intersects the row of generally vertical stitches.

9. Trousers for hunters, as set forth in claim 7 including:

a second rest pocket including a second generally triangular shaped panel attached to the second tubular trouser leg between the second knee and the second bottom edge by a second row of generally vertical stitches and a second row of generally horizontal stitches, and wherein the second rest pocket has a rest pocket opening extending from the second row of generally horizontal stitches upwardly and forwardly to the second row of generally vertical stitches.

10. Trousers for hunters, as set forth in claim 9 wherein the row of generally horizontal stitches on the first tubular trouser leg intersects the row of generally vertical stitches on the first tubular trouser leg; and the second row of generally horizontal stitches on the second tubular trouser leg intersects the second row of generally vertical stitches on the second tubular trouser leg.

11. A method of employing bow hunting trousers with a bow rest pocket on a trouser leg below a knee area and above a trouser leg bottom edge comprising:

sitting on a support surface in an area that game animals are expected to traverse;

inserting an archery bow lower end into the bow rest pocket in a position for use while the weight of the bow is supported by the bow rest pocket;

scanning the area to visually identify and locate wild animals;

drawing the bow and aiming at a wild animal that has moved to a position within range of the bow; and releasing an arrow while the lower end of the bow is still in the bow rest pocket.

* * * * *